US011965319B2

(12) United States Patent
Harada et al.

(10) Patent No.: US 11,965,319 B2
(45) Date of Patent: Apr. 23, 2024

(54) SYSTEM, METHOD AND DEVICE FOR CALIBRATING WORK MACHINE

(71) Applicant: KOMATSU LTD., Tokyo (JP)

(72) Inventors: Junji Harada, Tokyo (JP); Kentaro Takayama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 436 days.

(21) Appl. No.: 17/419,902

(22) PCT Filed: Feb. 17, 2020

(86) PCT No.: PCT/JP2020/006004

§ 371 (c)(1),
(2) Date: Jun. 30, 2021

(87) PCT Pub. No.: WO2020/171007

PCT Pub. Date: Aug. 27, 2020

(65) Prior Publication Data

US 2022/0081879 A1 Mar. 17, 2022

(30) Foreign Application Priority Data

Feb. 19, 2019 (JP) ..... 2019-027645

(51) Int. Cl.
*G01M 17/00* (2006.01)
*E02F 9/20* (2006.01)
*E02F 9/26* (2006.01)

(52) U.S. Cl.
CPC ..... *E02F 9/264* (2013.01); *E02F 9/202* (2013.01); *E02F 9/2025* (2013.01)

(58) Field of Classification Search
CPC ..... E02F 9/264; E02F 9/202; E02F 9/2025
See application file for complete search history.

(56) References Cited

U.S. PATENT DOCUMENTS

2012/0308354 A1* 12/2012 Tafazoli Bilandi ..... E02F 9/264 414/815
2013/0166143 A1 6/2013 Seki
(Continued)

FOREIGN PATENT DOCUMENTS

CN 105636658 A 6/2016
JP 2012-233353 A 11/2012
(Continued)

OTHER PUBLICATIONS

The Office Action for the corresponding Chinese application No. 202080014544.7, dated Apr. 22, 2022.
(Continued)

*Primary Examiner* — Adam M Alharbi
(74) *Attorney, Agent, or Firm* — Global IP Counselors, LLP

(57) ABSTRACT

A work machine includes a vehicle body and a work implement attached to the vehicle body. A system calibrates the work machine by using an external measurement apparatus. The system includes an attitude sensor, a positional sensor attached to the vehicle body, a storage device, an input device and a processor. The attitude sensor outputs attitude data indicative of an attitude of the vehicle body. The storage device stores machine data indicative of a position of the positional sensor in a vehicle body coordinate system. The input device receives an input of calibration data including a position of a predetermined measurement point on the work machine measured by the external measurement apparatus, and a position of the positional sensor measured by the external measurement apparatus. The processor calibrates the machine data based on the calibration data and the attitude data.

20 Claims, 13 Drawing Sheets

(56) References Cited

U.S. PATENT DOCUMENTS

| | | | | |
|---|---|---|---|---|
| 2014/0032030 | A1* | 1/2014 | Stratton | E02F 9/2025 701/33.9 |
| 2014/0324291 | A1* | 10/2014 | Jones | E02F 9/2054 701/41 |
| 2015/0330060 | A1 | 11/2015 | Seki et al. | |
| 2018/0038082 | A1 | 2/2018 | Hashimoto et al. | |
| 2020/0080287 | A1 | 3/2020 | Shimano et al. | |
| 2020/0157774 | A1 | 5/2020 | Shimano et al. | |

FOREIGN PATENT DOCUMENTS

| | | | |
|---|---|---|---|
| JP | 2018-21348 | A | 2/2018 |
| JP | 2019-19537 | A | 2/2019 |
| JP | 2019-19538 | A | 2/2019 |
| WO | 2012/128199 | A1 | 9/2012 |
| WO | 2015/173920 | A1 | 11/2015 |

OTHER PUBLICATIONS

The International Search Report for the corresponding international application No. PCT/JP2020/006004, dated Apr. 21, 2020.

* cited by examiner

SYSTEM, METHOD AND DEVICE FOR CALIBRATING WORK MACHINE

This application is a U.S. National stage application of International Application No. PCT/JP2020/006004, filed on Feb. 17, 2020. This U.S. National stage application claims priority under 35 U.S.C. § 119(a) to Japanese Patent Application No. 2019-027645, filed in Japan on Feb. 19, 2019, the entire contents of which are hereby incorporated herein by reference.

BACKGROUND

Field of the Invention

The present disclosure relates to a system, a method, and a device for calibrating a work machine.

Background Information

Conventionally, techniques for detecting the position of a work machine have been proposed in a work machine such as a bulldozer. For example, Japanese Patent Laid-open No. 2018-021348 is a work machine provided with a work implement, a positional sensor, a storage device, and a controller. The work implement is attached to the vehicle body. The positional sensor detects the position of the vehicle body. The storage device stores machine data. The machine data represents the position of the positional sensor in a vehicle body coordinate system. The controller calculates the position of the work implement based on the position data and the machine data acquired by the positional sensor.

SUMMARY

The machine data is affected by tolerances in the constitutional components of the vehicle body. Therefore, variation may easily arise in the position detection accuracy of the positional sensor as indicated above due to individual work machines. In addition, the position detection accuracy may deteriorate due to wear of the constitutional components of the work machine.

The accuracy of the position of the work implement can be improved by calibrating the machine data using an external measurement apparatus such as a total station. However, the number of measurement points increases in such a case and calibration work becomes complicated.

An object of the present disclosure is to simplify the calibration work for a work machine.

A first aspect is a system for calibrating a work machine by using an external measurement apparatus. The work machine includes a vehicle body and a work implement attached to the vehicle body. The system comprises an attitude sensor, a positional sensor, a storage device, an input device, and a processor. The attitude sensor outputs attitude data indicative of the attitude of the vehicle body. The positional sensor is attached to the vehicle body. The storage device stores machine data. The machine data represents a position of the positional sensor in a vehicle body coordinate system. The input device receives an input of calibration data. The calibration data includes a position of a predetermined measurement point on the work machine measured by the external measurement apparatus, and a position of the positional sensor measured by the external measurement apparatus. The processor calibrates the machine data based on the calibration data and the attitude data.

A second aspect is a method executed by a processor for calibrating a work machine by using an external measurement apparatus. The work machine includes a vehicle body, a work implement, an attitude sensor, and a positional sensor. The work implement is attached to the vehicle body. The attitude sensor outputs attitude data indicative of the attitude of the vehicle body. The positional sensor is attached to the vehicle body. The method includes the following processes. A first process is acquiring the attitude data. A second process is acquiring calibration data. The calibration data includes the position of a predetermined measurement point on the work machine measured by the external measurement apparatus, and the position of the positional sensor measured by the external measurement apparatus. A third process is calibrating machine data based on the calibration data and the attitude data. The machine data represents the position of the positional sensor in a vehicle body coordinate system.

A third aspect is a device for calibrating a work machine by using an external measurement apparatus. The work machine includes a vehicle body, a work implement, an attitude sensor, and a positional sensor. The work implement is attached to the vehicle body. The attitude sensor outputs attitude data indicative of the attitude of the vehicle body. The positional sensor is attached to the vehicle body. The device comprises an input device and a processor. The input device receives an input of calibration data. The calibration data includes the position of a predetermined measurement point on the work machine measured by the external measurement apparatus, and the position of the positional sensor measured by the external measurement apparatus. The processor calibrates machine data based on the calibration data and the attitude data. The machine data represents the position of the positional sensor in a vehicle body coordinate system.

According to the present disclosure, the machine data is calibrated based on the calibration data and the attitude data. The attitude data is acquired by the attitude sensor. As a result, the number of measurement points for detecting the attitude of the vehicle body can be reduced. Consequently, the calibration work for the work machine can be simplified.

DETAILED DESCRIPTIONS OF EMBODIMENT(S)

Figure 1:
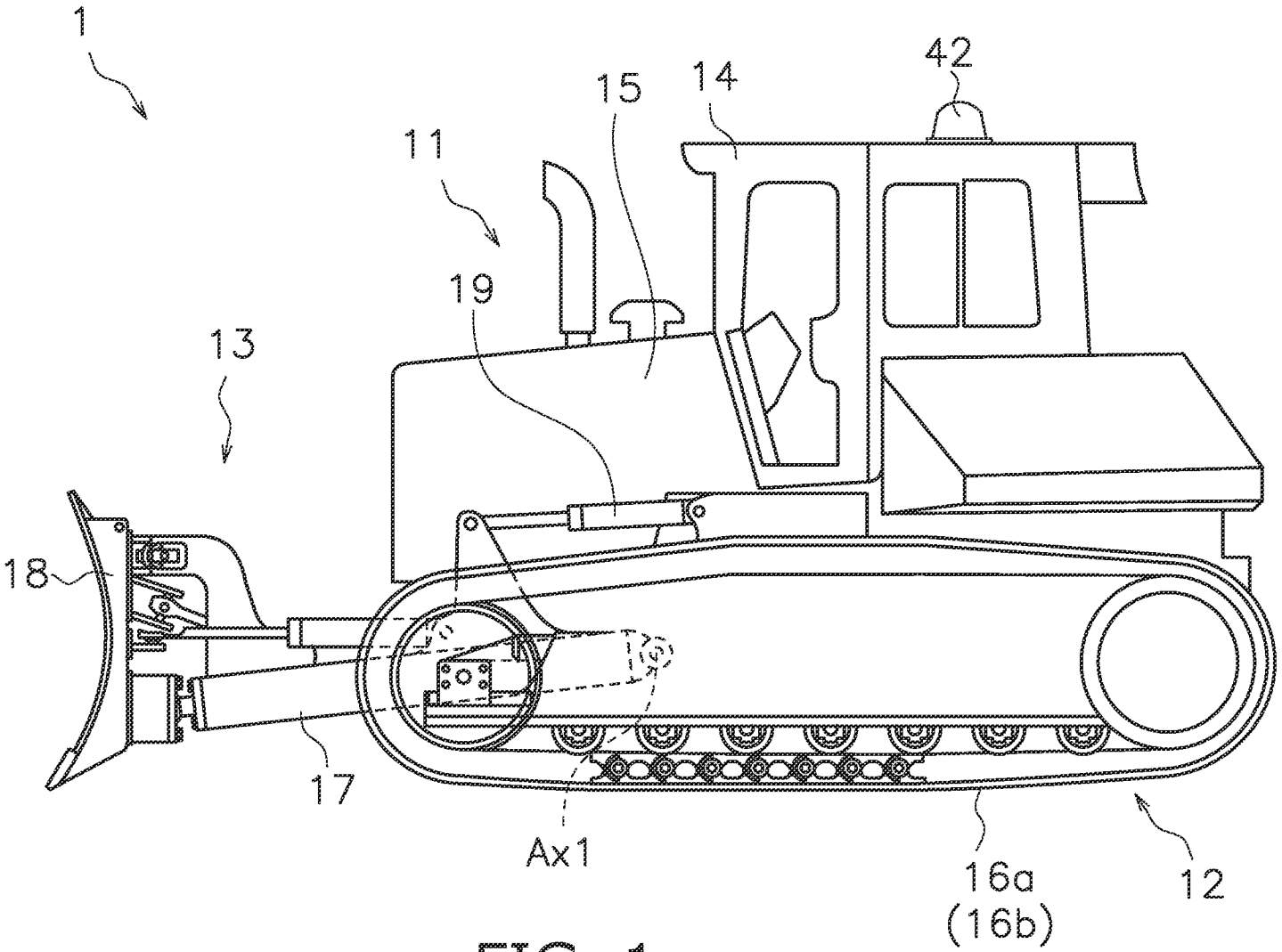
FIG. 1 is a side view of a work machine according to an embodiment.

A work machine according to an embodiment is discussed hereinbelow with reference to the drawings. FIG. 1 is a side view of a work machine 1 according to the embodiment. The work machine 1 according to the present embodiment is a bulldozer. The work machine 1 includes a vehicle body 11, a travel device 12, and a work implement 13.

The vehicle body 11 has an operating cabin 14 and an engine compartment 15. An operator's seat that is not illustrated is disposed inside the operating cabin 14. The engine compartment 15 is disposed in front of the operating cabin 14. The travel device 12 is attached to a bottom part of the vehicle body 2. The travel device 12 includes left and right crawler belts 16*a* and 16*b*. Only the crawler belt 16*a* on the left side is illustrated in FIG. 1. The work machine 1 travels due to the rotation of the crawler belts 16*a* and 16*b*.

The work implement 13 is attached to the vehicle body 11. The work implement 1 has a lift frame 17, a blade 18, and a lift cylinder 19. The lift frame 17 is attached to the vehicle body 11 in a manner that allows movement up and down about an axis Ax1. The axis Ax1 extends in the vehicle width direction. The lift frame 17 supports the blade 18.

The blade 18 is disposed in front of the vehicle body 11. The blade 18 moves up and down accompanying the up and down movements of the lift frame 17. The lift frame 17 may be attached to the travel device 12. The lift cylinder 19 is coupled to the vehicle body 11 and the lift frame 17. Due to the extension and contraction of the lift cylinder 19, the lift frame 17 moves up and down about the axis Ax1.

Figure 2:
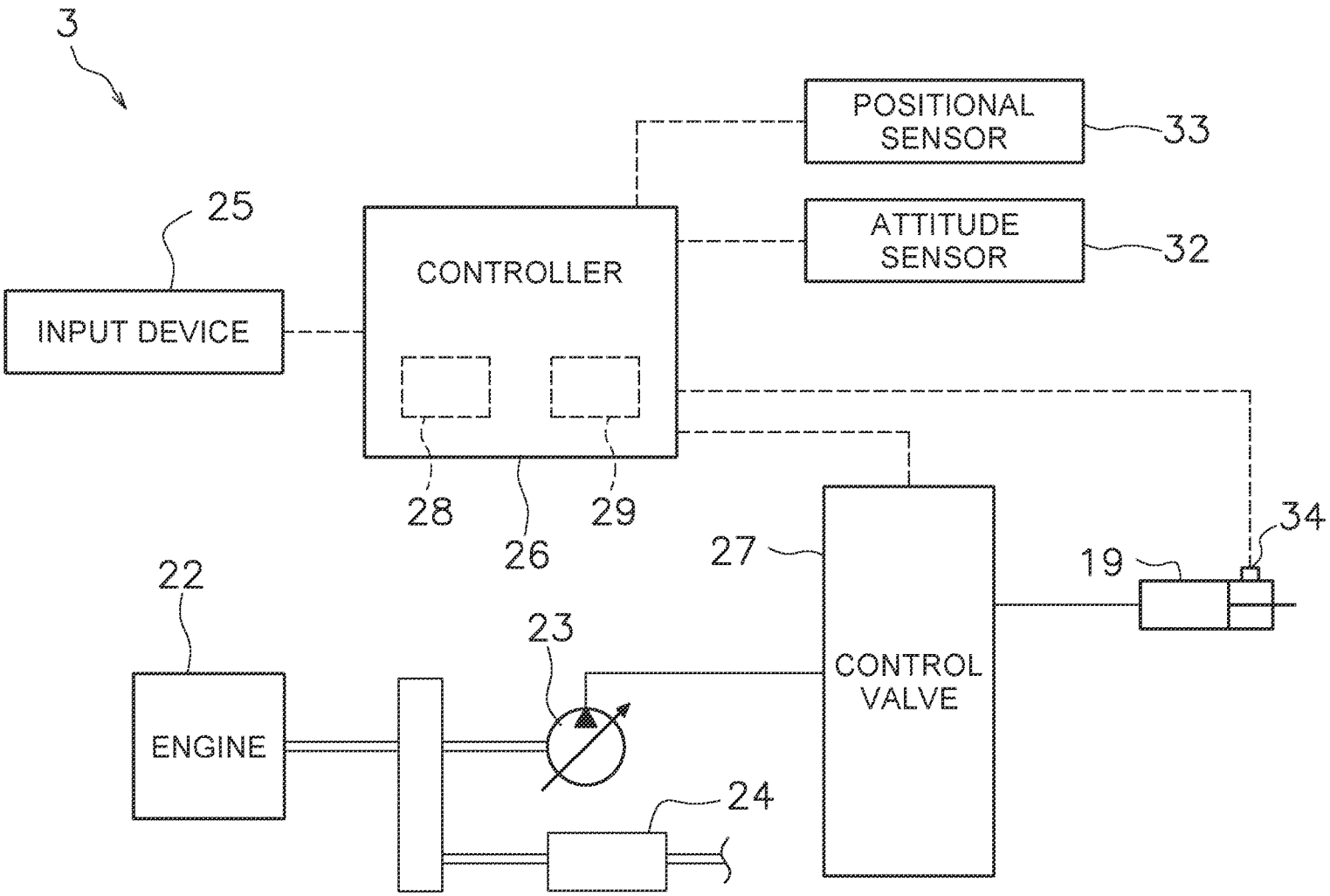
FIG. 2 is a block diagram illustrating a configuration of a control system of the work machine.

FIG. 2 is a block diagram illustrating a configuration of a control system 3 of the work machine 1. In the present embodiment, the control system 3 is mounted in the work machine 1. As illustrated in FIG. 2, the work machine 1 includes an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to the lift cylinder 19. While only one hydraulic pump 23 is illustrated in FIG. 2, a plurality of hydraulic pumps may be provided.

The power transmission device 24 transmits the driving power of the engine 22 to the travel device 12. The power transmission device 24 may be, for example, a hydrostatic transmission (HST). Alternatively, the power transmission device 24 may be, for example, a transmission having a torque converter or a plurality of speed change gears.

The control system 3 includes an input device 25, a controller 26, and a control valve 27. The input device 25 is disposed in the operating cabin 14. The input device 25 receives operations by an operator and outputs operation signals corresponding to the operations. The input device 25 outputs the operation signals to the controller 26. The input device 25 includes operation pieces such as an operating lever, a pedal, or a switch for operating the travel device 12 and the work implement 13. The input device 25 may include a touch screen. The travel of the work machine 1 such as forward travel or reverse travel is controlled in accordance with the operation of the input device 25. The operation of the work implement 13 such as raising or lowering is controlled in accordance with the operation of the input device 25.

The controller 26 is programmed to control the work machine 1 based on acquired data. The controller 26 includes a storage device 28 and a processor 29. The storage device 28 includes a non-volatile memory such as a ROM and a volatile memory such as a RAM. The storage device 28 may include an auxiliary storage device such as a hard disk or a solid state drive (SSD). The storage device 28 is an example of a non-transitory computer-readable recording medium. The storage device 28 stores computer commands and data for controlling the work machine 1.

The processor 29 is, for example, a central processing unit (CPU). The processor 29 executes processing for controlling the work machine 1 in accordance with a program. The controller 26 controls the travel device 12 or the power transmission device 24 thereby causing the work machine 1 to travel. The controller 26 controls the control valve 27 whereby the blade 18 is moved up and down.

The control valve 27 is a proportional control valve and is controlled with command signals from the controller 26. The control valve 27 is disposed between the hydraulic pump 23 and hydraulic actuators such as the lift cylinder 19. The control valve 27 controls the flow rate of the hydraulic fluid supplied from the hydraulic pump 23 to the lift cylinder 19. The controller 26 generates a command signal to the control valve 27 to move the blade 18. As a result, the lift cylinder 19 is controlled. The control valve 27 may be a pressure proportional control valve. Alternatively, the control valve 27 may be an electromagnetic proportional control valve.

Figure 3:
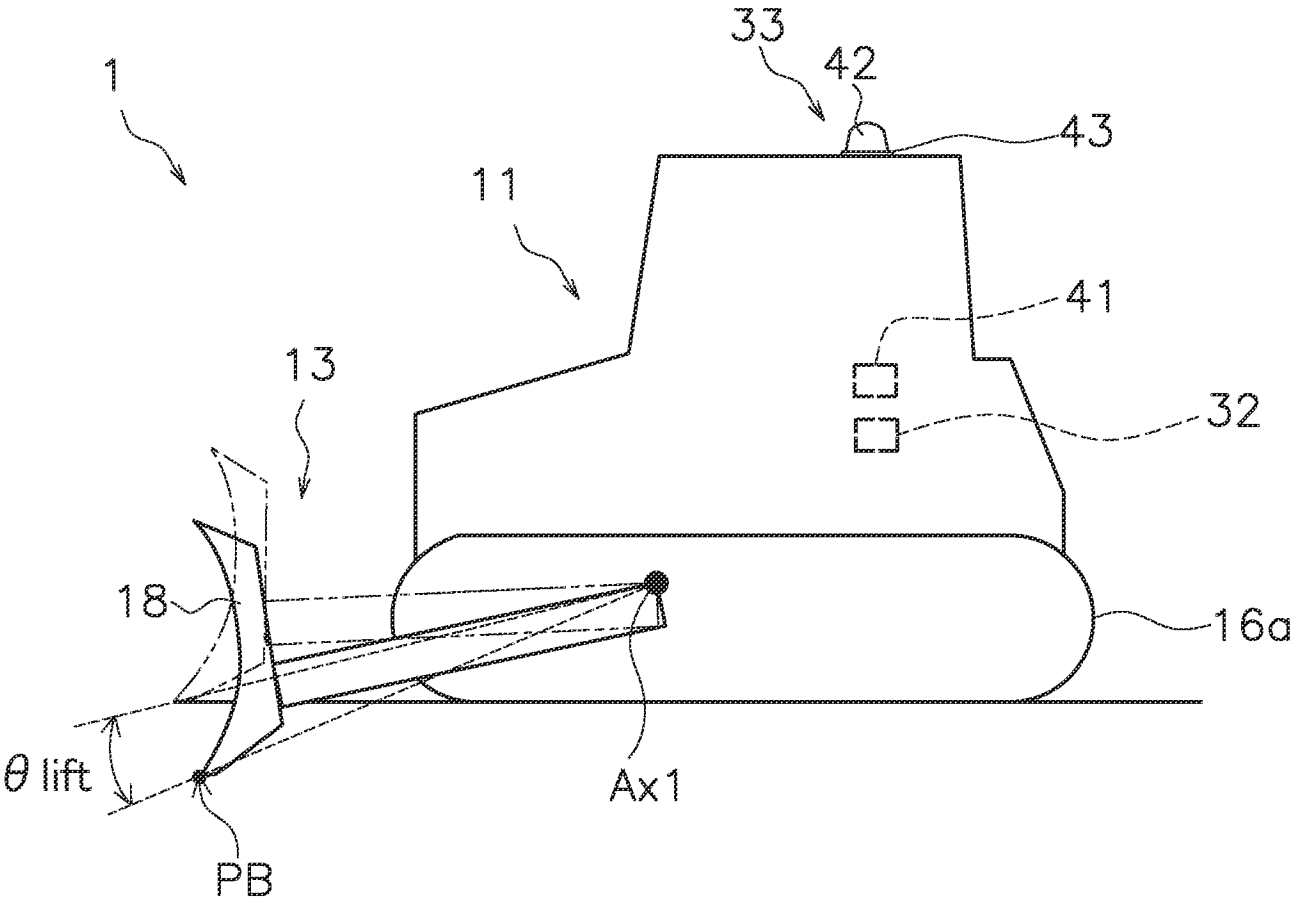
FIG. 3 is a side view schematically illustrating the work machine.

The control system 3 includes a work implement sensor 34. The work implement sensor 34 acquires work implement position data. The work implement position data represents the position of the work implement 13 with respect to the vehicle body 11. The work implement position data includes a lift angle θlift. The work implement sensor 34 detects the lift angle θlift of the blade 18 as illustrated in FIG. 3. For example, the work implement sensor 34 detects the stroke length of the lift cylinder 19. The controller 26 calculates the lift angle θlift of the blade 18 from the stroke length of the lift cylinder 19. Alternatively, the work implement sensor 34 may be sensor for directly detecting the rotation angle of the blade 18 about the axis Ax1.

Figure 4A:
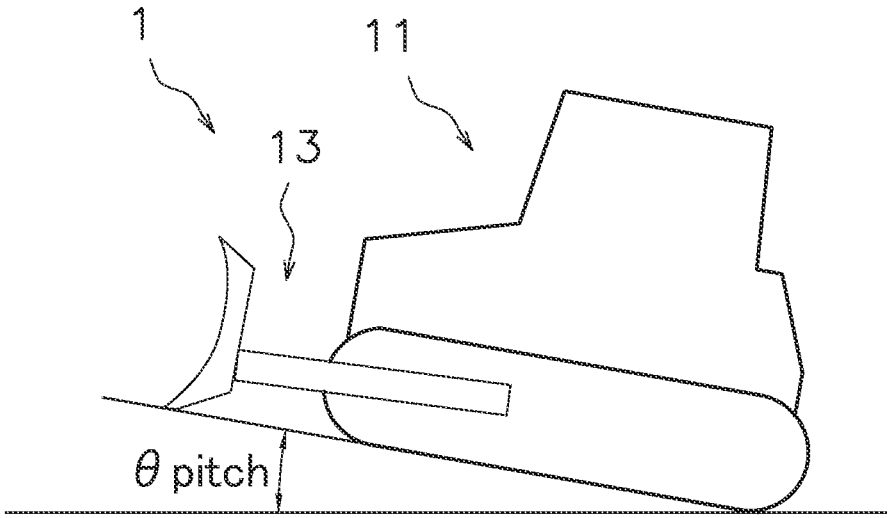
FIG. 4A and FIG. 4B illustrate a pitch angle and a roll angle of the work machine.
Figure 4B:
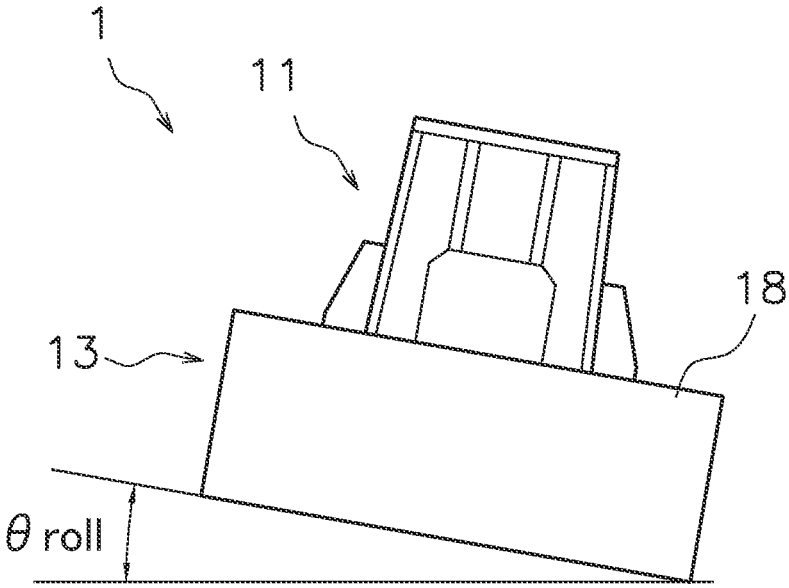

As illustrated in FIG. 2, the system 3 includes an attitude sensor 32 and a positional sensor 33. The attitude sensor 32 outputs attitude data indicative of the attitude of the vehicle body 11. The attitude sensor 32 includes, for example, an inertial measurement unit (IMU). The attitude data includes a pitch angle θpitch and a roll angle θroll. As illustrated in FIG. 4A, the pitch angle θpitch is an angle in the front-back direction of the vehicle body 11 with respect to the horizon. As illustrated in FIG. 4B, the roll angle θroll is an angle in the vehicle width direction of the vehicle body 11 with respect to the horizon. The attitude sensor 32 outputs the attitude data to the controller 26.

The positional sensor 33 includes, for example, a receiver 41 of a global navigation satellite system (GNSS) such as a global positioning system (GPS), and an antenna 42. The receiver 41 and the antenna 42 are mounted to the vehicle body 11. The antenna 42 is attached to the outer surface of the vehicle body 11. For example, the antenna 42 is attached to the top surface of the operating cabin 14. However, the antenna 42 may be attached to another portion of the vehicle body 11.

The positional sensor 33 receives positioning signals from a satellite and acquires vehicle body position data from the positioning signals. The vehicle body position data represents the position of the vehicle body 11 in a global coordinate system. The global coordinates indicate the position in a geographical coordinate system. Specifically, the positional sensor 33 acquires the position of the antenna 42 in the global coordinate system as the vehicle body position data. The positional sensor 33 outputs the vehicle body position data to the controller 26. The controller 26 derives the traveling direction and the vehicle speed of the work machine 1 from the vehicle body position data.

The controller 26 computes a blade tip position PB of the work implement 13 from the work implement position data, the vehicle body position data, and the attitude data Specifically, the controller 26 calculates the position of the antenna 42 in the global coordinates based on the vehicle body position data. The controller 26 calculates the blade tip position PB in a vehicle body coordinate system based on the work implement position data and machine data. The vehicle body coordinates include a coordinate system centered on the vehicle body 11.

The machine data is recorded in the storage device 28. The machine data represents the position of the work implement 13 with respect to the vehicle body 11. The machine data includes the positions and dimensions of a plurality of constitutional elements included in the work machine 1. For example, the machine data includes the position of the antenna 42 with respect to a predetermined reference point of the vehicle body 11. The machine data includes the position of the axis Ax1 with respect to the predetermined reference point. The machine data includes the dimensions of the lift frame 17 and the dimensions of the blade 18.

The controller 26 calculates the blade tip position PB in the global coordinate system based on the position of the vehicle body 11 in the global coordinate system, the blade tip position PB in the vehicle body coordinate system, and the attitude data. The controller 26 acquires the blade tip position PB in the global coordinate system as blade tip position data. The positional sensor 33 may be attached to the blade 18. In this case, the blade tip position PB in the global coordinate system may be acquired directly by the positional sensor 33.

Figure 5:
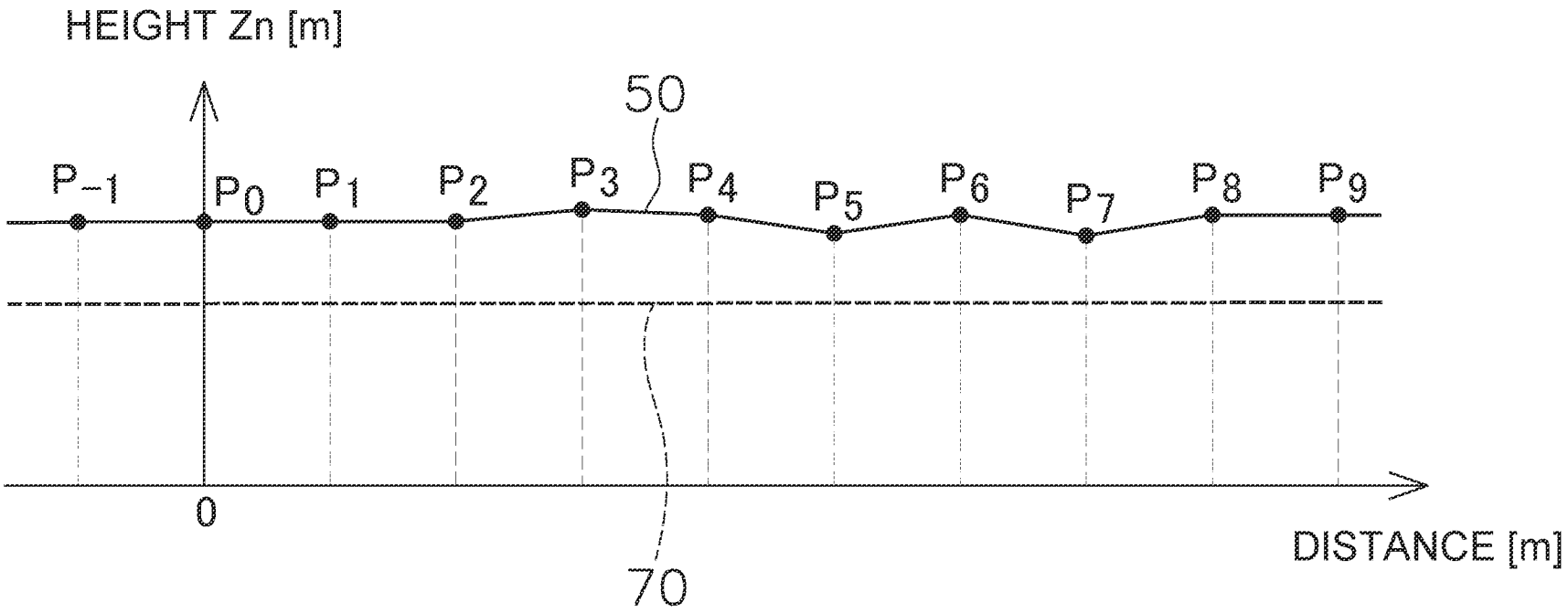
FIG. 5 is a side cross-section illustrating current terrain data.

The controller 26 acquires current terrain data. The current terrain data represents the current terrain of a work site. The current terrain data represents a three-dimensional survey image of the current terrain. FIG. 5 is a side cross-section illustrating the current terrain 50. In FIG. 5, the vertical axis indicates the height of the terrain and the horizontal axis indicates the distance from the current position in the traveling direction of the work machine 1.

As illustrated in FIG. 5, the current terrain data represents positions of a plurality of points Pn (where n is an integer) on the current terrain 50. The current terrain data represents global coordinates of the plurality of points Pn on the current terrain 50. The current terrain data represents a height Zn at the plurality of points Pn. The plurality of points Pn are disposed in predetermined intervals. The predetermined interval is, for example, 1 m. However, the predetermined interval may be a distance other than 1 m.

The controller 26 performs automatic control of the work machine 1. The automatic control of the work machine 1 may be a semi-automatic control that is performed in accompaniment to manual operations by an operator. Alternatively, the automatic control of the work machine 1 may be a fully automatic control that is performed without manual operations by an operator. The controller 26 automatically controls the work implement 13 based on the blade tip position data.

For example, as illustrated in FIG. 5, the controller 26 determines a target locus 70 of the work implement 13. At least a portion of the target locus 70 is positioned below the current terrain 50. The controller 26 causes the work implement 13 to move in accordance with the target locus 70.

Specifically, the controller 26 generates command signals for the work implement 13 so as to move the blade tip position PB of the blade 18 in accordance with the target locus 70. The controller 26 outputs the command signals to the control valve 27. Consequently, the work implement 13 acts in accordance with the target locus 70. The work machine 1 causes the work implement 13 to act in accordance with the target locus 70 while traveling forward. As a result, the current terrain 50 is excavated with the work implement 13.

Alternatively, the target locus 70 may be positioned higher than the current terrain 50. In this case, the work machine is able to perform earth piling work on the current terrain 50.

Figure 6:
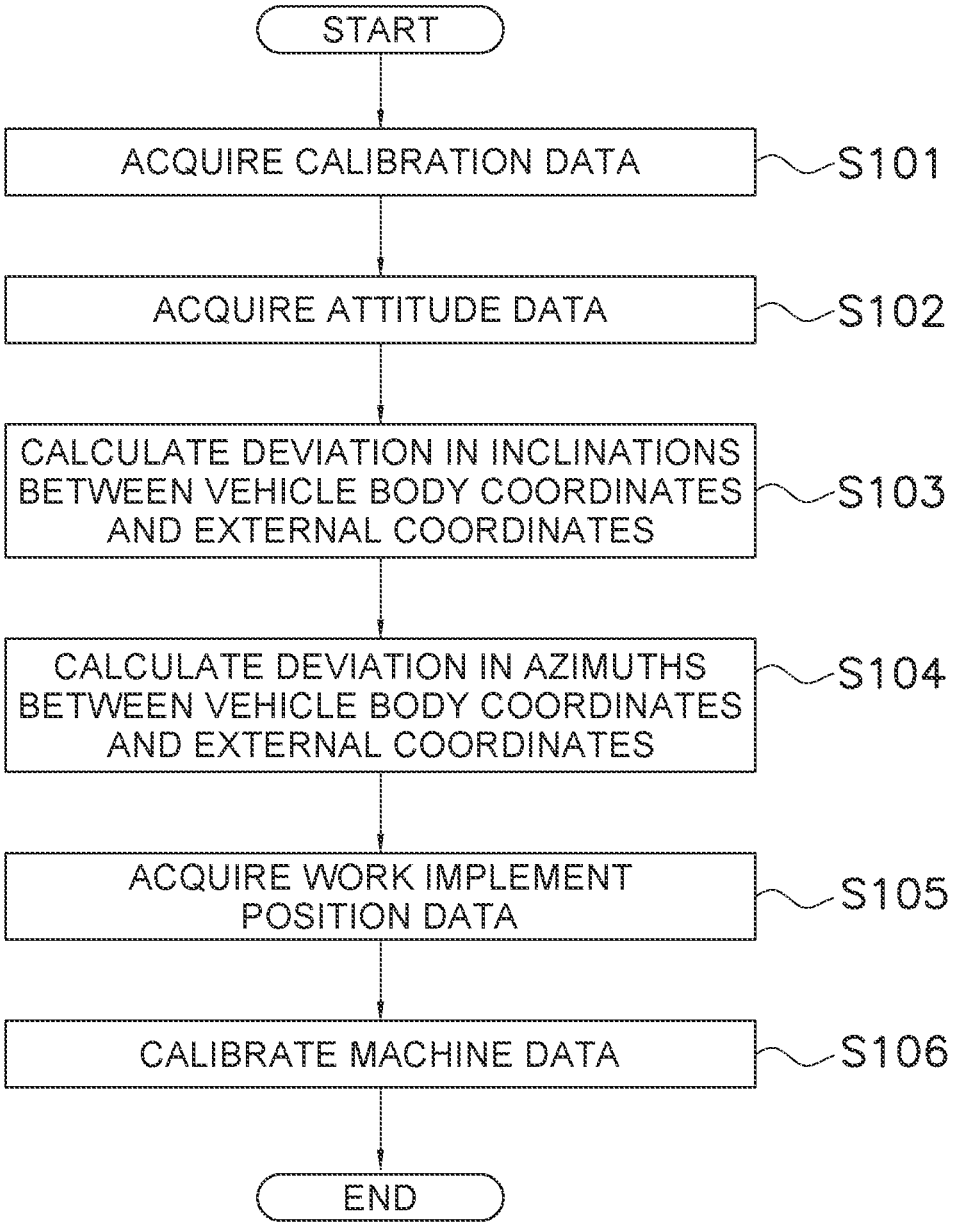
FIG. 6 is a flow chart of calibration processing of the work machine.

Next, a process for calibrating the machine data is explained. The controller calibrates the machine data by using calibration data measured by an external measurement apparatus 100. Specifically, the controller calibrates the position of the antenna 42 in the vehicle body coordinate system. FIG. 6 is a flow chart illustrating processing for calibrating the position of the antenna 42 in the vehicle body coordinate system.

It is assumed that the machine data for calculating the blade tip position PB in the vehicle body coordinate system has been previously calibrated. In addition, it is assumed that the attachment position and the attachment bearing of the attitude sensor 32 in the vehicle body coordinate system has already been calibrated. The calibration of the above data items may be performed by a known calibration method.

In step S101, as illustrated in FIG. 6, the controller 26 acquires the calibration data. The calibration data is inputted to the controller 26 through the input device 25. For example, an operator may input numerical values representing the calibration data in the input device 25.

Figure 7:
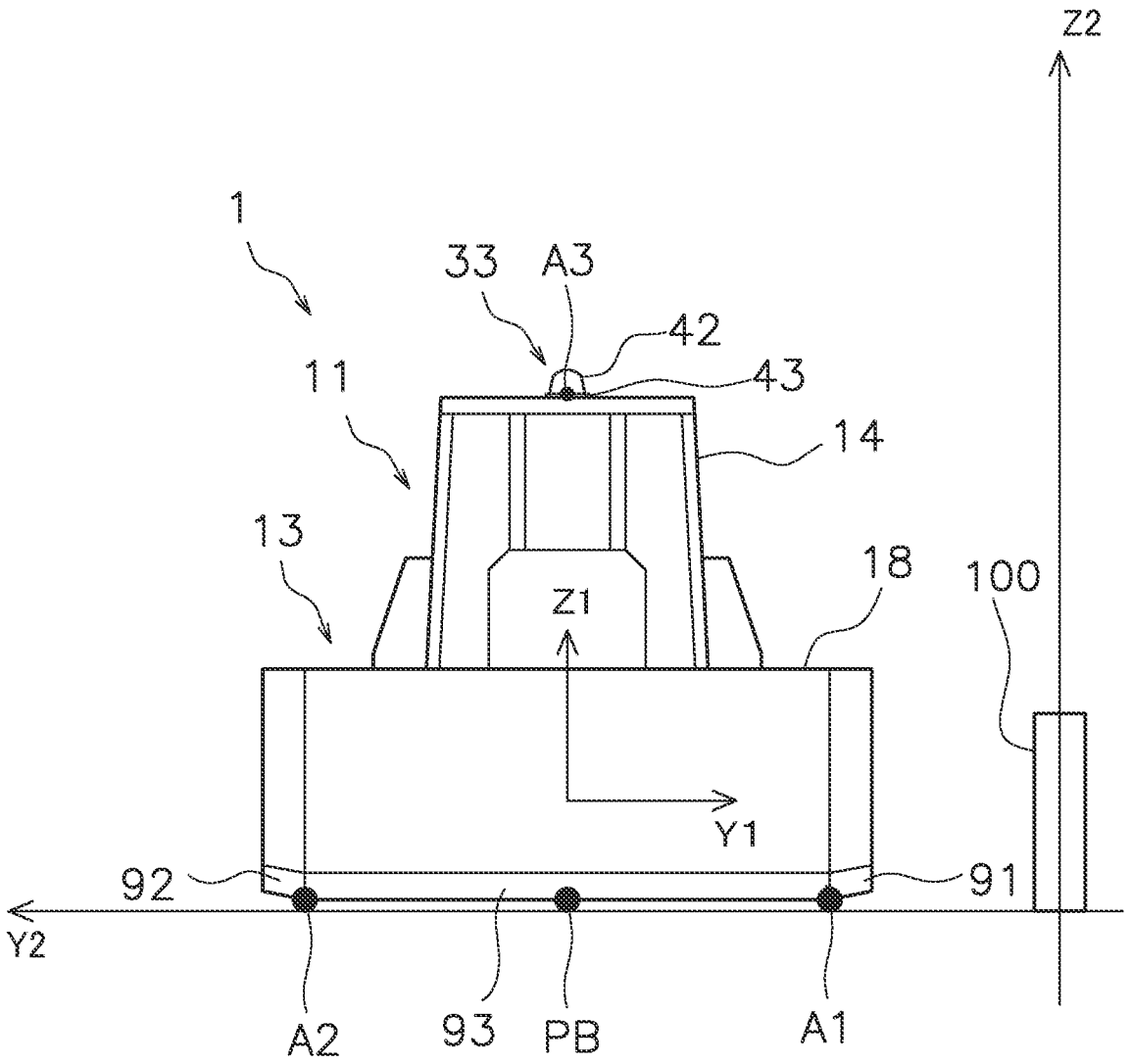
FIG. 7 is a front view of the work machine illustrating positions of measurement points.
Figure 8:
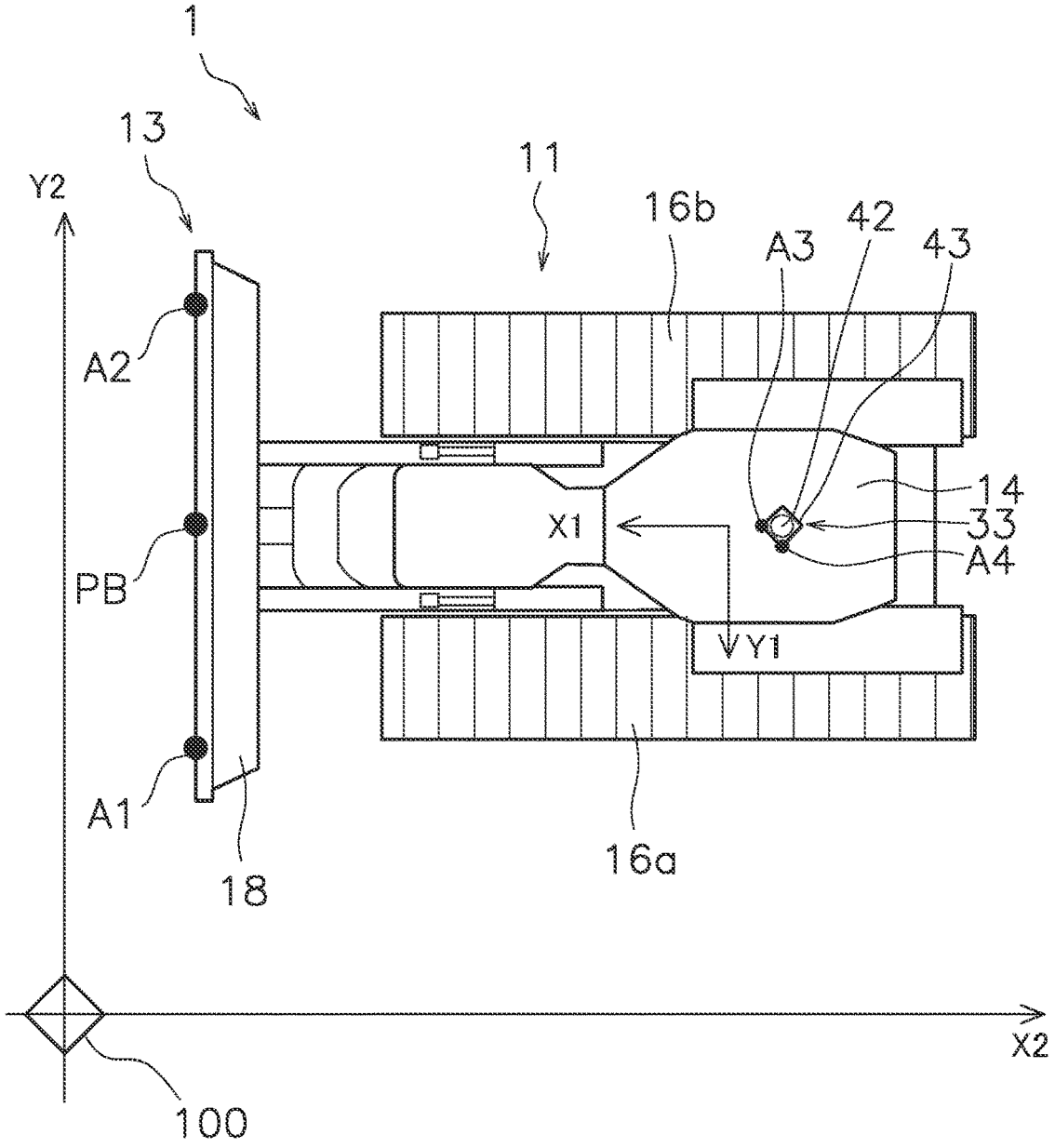
FIG. 8 is a top view of the work machine illustrating the positions of the measurement points.

The calibration data represents positions of a plurality of predetermined measurement points A1 to A4 on the work machine 1. FIG. 7 is a front view of the work machine 1 illustrating the plurality of measurement points A1 to A4. FIG. 8 is a top view of the work machine 1 illustrating the plurality of measurement points A1 to A4. The positions of the plurality of measurement points A1 to A4 are measured by the external measurement apparatus 100. The external measurement apparatus 100 is, for example, a total station. However, the external measurement apparatus 100 may be a surveying device other than a total station.

The positions of the measurement points A1 to A4 are represented by external coordinates based on the outside of the work machine 1. The external coordinates may be coordinates based on the external measurement apparatus 100. Alternatively, the external coordinates may be the abovementioned global coordinates.

In FIGS. 7 and 8, X1-Y1-Z1 indicate the vehicle body coordinate system. X2-Y2-Z2 indicate the external coordinate system. As illustrated in FIG. 7, the plurality of measurement points A1 to A4 include the first measurement point A1, the second measurement point A2, the third measurement point A3, and the fourth measurement point A4. The first measurement point A1 and the second measurement point A2 are included on the work implement 13.

The third measurement point A3 and the fourth measurement point A4 are included on the positional sensor 33.

Specifically, the first measurement point A1 and the second measurement point A2 are two points on the blade tip of the blade 18 and are spaced away from each other in the vehicle width direction of the work machine 1. The first measurement point A1 and the second measurement point A2 are positions further inside in the vehicle width direction than the left and right ends of the blade tip. As illustrated in FIG. 7, the blade tip of the blade 18 includes a left plate portion 91, a right plate portion 92, and a center plate portion 93. The left plate portion 91 is positioned leftward of the center plate portion 93. The right plate portion 92 is positioned rightward of the center plate portion 93. The first measurement point A1 is positioned on the boundary line of the left plate portion 91 and the center plate portion 93. The second measurement point A2 is positioned on the boundary line of the right plate portion 92 and the center plate portion 93.

The third measurement point A3 and the fourth measurement point A4 are points on a bracket 43 for attaching the antenna 42 to the vehicle body. The bracket 43 has a polygonal shape. The antenna 42 is positioned in the center of the bracket 43. The third measurement point A3 and the fourth measurement point A4 are positioned on corners of the bracket 43. The controller 26 calculates the position of the antenna 42 in the external coordinate system from the third measurement point A3 and the fourth measurement point A4.

In step S102, the controller 26 acquires the attitude data. As indicated above, the controller 26 acquires the pitch angle θpitch and the roll angle θroll of the vehicle body 11 from the attitude sensor 32.

In step S103, the controller 26 calculates deviation in the inclinations of the vehicle body coordinates and the external coordinates. The controller 26 calculates the deviation of an axis in the pitch angle θpitch direction and the deviation of an axis in the roll angle θroll direction between the vehicle body coordinates and the external coordinates from the pitch angle θpitch and the roll angle θroll of the vehicle body 11 acquired from the attitude sensor 32.

In step S104, the controller 26 calculates deviation in the azimuths of the vehicle body coordinates and the external coordinates. The controller 26 calculates the deviation in the azimuths of the vehicle body coordinates and the external coordinates from the first measurement point A1 and the second measurement point A2.

In step S105, the controller 26 acquires the work implement position data. The controller 26 acquires the work implement position data of the first measurement point A1 and the second measurement point A2 in the vehicle body coordinate system with the work implement sensor 34.

In step S106, the controller 26 calibrates the machine data. The controller 26 converts the position of the antenna 42 in the external coordinate system to the position of the antenna 42 in the vehicle body coordinate system from the deviation in the inclinations and the deviation in the azimuths of the vehicle body coordinates and the external coordinates, and the work implement position data. The controller 26 records the difference between the converted position of the antenna 42 and the position of the antenna 42 in the machine data, as a correction value.

As explained above, in the control system 3 of the work machine 1 according to the present embodiment, the machine data is calibrated based on the calibration data and the attitude data. The attitude data is acquired by the attitude sensor 32. As a result, the number of measurement points for detecting the attitude of the vehicle body 11 can be reduced. Consequently, the calibration work of the work machine 1 can be simplified.

Although an embodiment of the present invention has been described so far, the present invention is not limited to the above embodiment and various modifications may be made within the scope of the invention.

The work machine is not limited to a bulldozer and may be another type of machine such as a wheel loader, a motor grader, a hydraulic excavator, or the like. The work machine 1 may be driven by an electric motor. In this case, the engine 22 and the engine compartment 15 may be omitted.

The controller 26 may have a plurality of controllers provided separately from each other. The abovementioned processing may be distributed and executed among the plurality of controllers 26.

Figure 9:
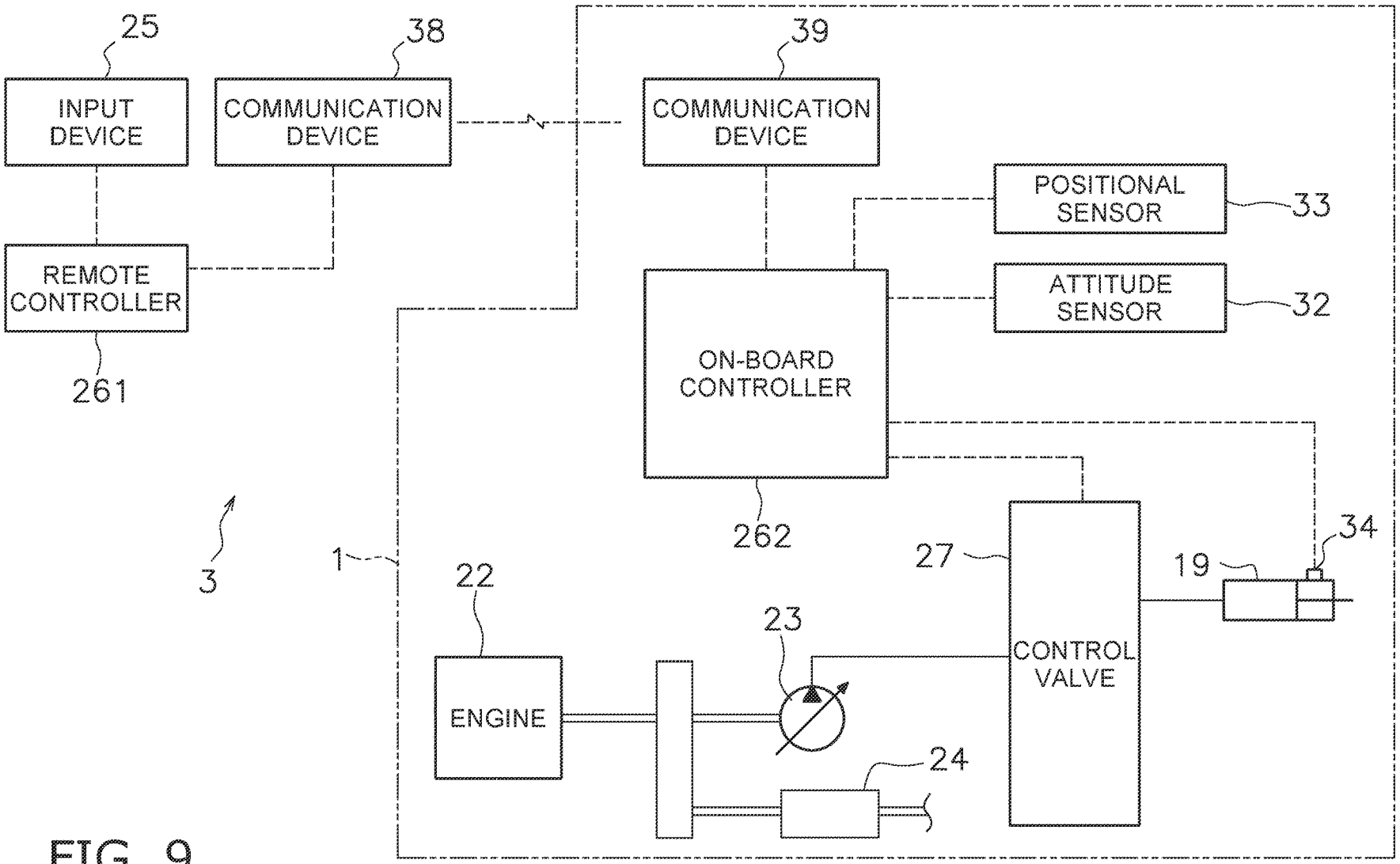
FIG. 9 is a block diagram illustrating a first modified example of a configuration of the control system.

The work machine 1 may be a vehicle that can be remotely operated. In this case, a portion of the control system 3 may be disposed outside of the work machine 1. For example as illustrated in FIG. 9, the controller 26 may include a remote controller 261 and an on-board controller 262. The remote controller 261 may be disposed outside the work machine 1. For example, the remote controller 261 may be disposed in a management center outside of the work machine 1. The on-board controller 262 may be mounted on the work machine 1. The remote controller 261 and the on-board controller 262 may be able to communicate wirelessly through communication devices 38 and 39.

The abovementioned processing for calibrating the machine data may be executed by the remote controller 261. Alternatively, the processing for calibrating the machine data may be executed by the on-board controller 262. Alternatively, a portion of the processing for calibrating the machine data may be executed by the remote controller 261 and the remaining processing may be executed by the on-board controller 262.

The input device 42 may be disposed outside of the work machine 1. The input device 25 may be omitted from the work machine 1. In this case, the operating cabin may be omitted from the work machine 1.

Figure 10:
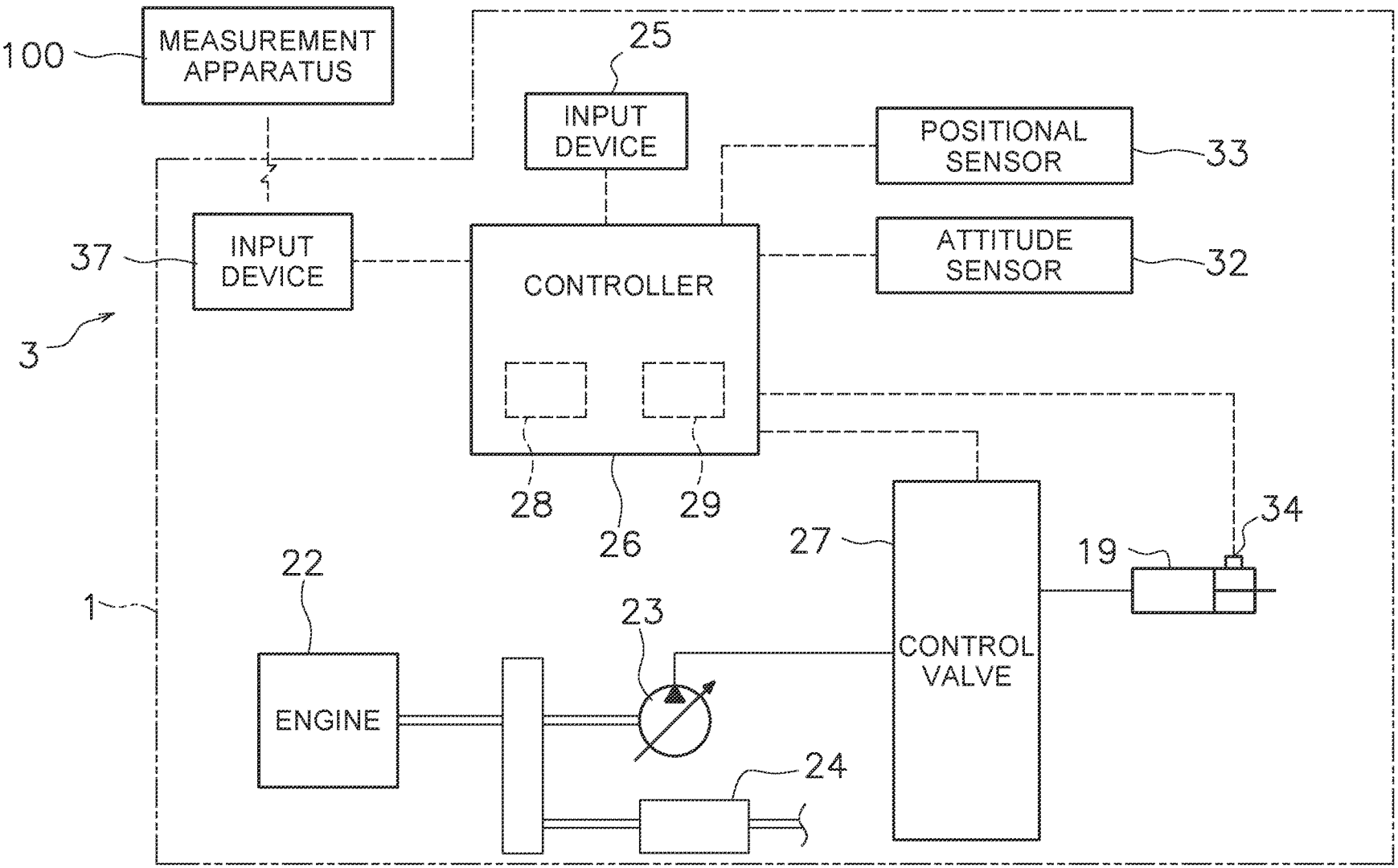
FIG. 10 is a block diagram illustrating a second modified example of a configuration of the control system.

For example, as illustrated in FIG. 10, the calibration data may be acquired with another input device 37 that receives data from an external device. The input device 37 may wirelessly receive the calibration data measured by the external measurement apparatus 100. Alternatively, the input device 37 may be a device for reading a recording medium. The controller 26 may receive the calibration data measured by the external measurement apparatus 100 through the recording medium.

The positional sensor 33 is not limited to the receiver 41 and the antenna 42 and may be another type of sensor. For example, the positional sensor 33 may be a ranging device such as a LIDAR device. Alternatively, the positional sensor 33 may be a stereo camera. Alternatively, the positional sensor 33 may be an inertial measurement unit (IMU). The controller 26 may calibrate the positions of the sensors in the vehicle body coordinate system with a method similar to the above calibration method.

Figure 11:
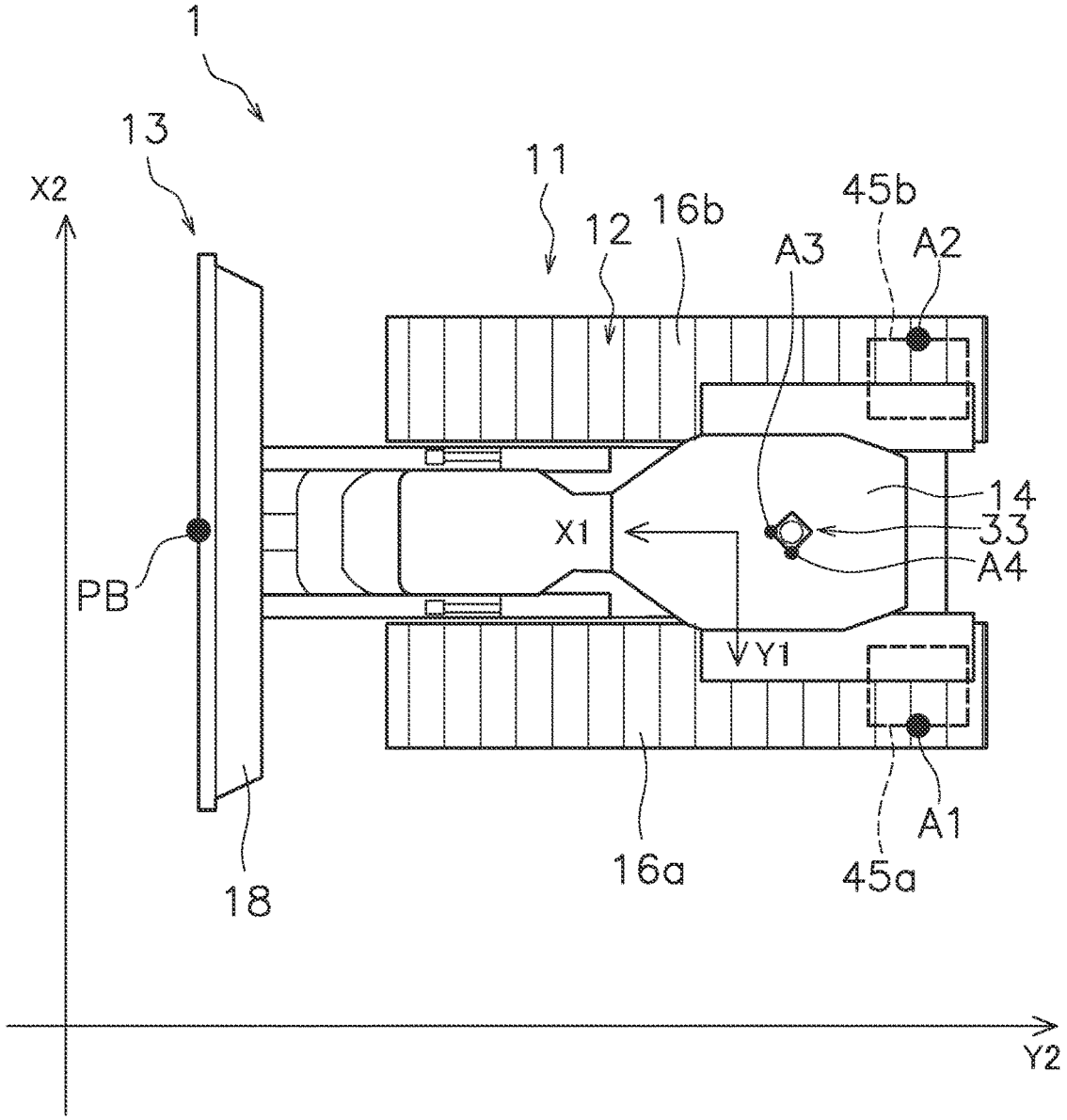
FIG. 11 illustrates a first modified example of the measurement points.

In the above embodiment, the first measurement point 1 and the second measurement point A2 are included on the work implement 13. However, the first measurement point 1 and the second measurement point A2 may be included on the vehicle body 11. For example, as illustrated in FIG. 11, the travel device 12 of the work machine 1 includes sprockets 45*a* and 45*b* for driving the respective crawler belts 16*a* and 16*b*.

The first measurement point A1 and the second measurement point A2 may be respectively included on the left and right sprockets 45*a* and 45*b*. For example, the first measurement point A1 may be the center of the left sprocket 45*a* The second measurement point A2 may be the center of the right sprocket 45*b*. Alternatively, positions of portions other than the sprockets 45*a* and 45*b* on the vehicle body 11 may be measured as the first measurement point A1 and the second measurement point A2.

The number of measurement points other than the positional sensor 33 is two in the above embodiment. However, the number of measurement points other than the positional sensor 33 is not limited to two and may be less than two or greater than two.

Figure 12:
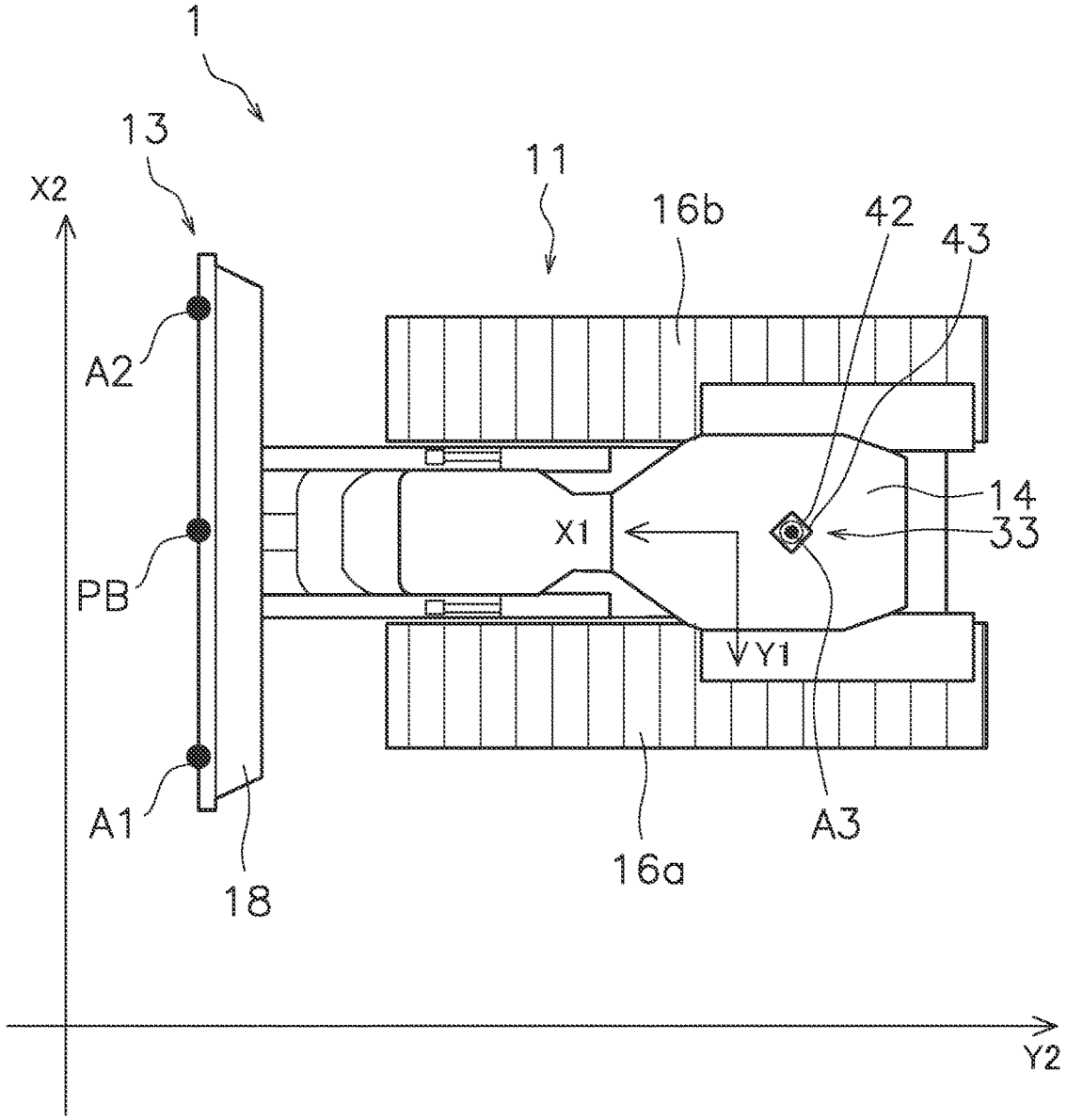
FIG. 12 illustrates a second modified example of the measurement points.

The two measurement points A3 and A4 are measured by the external measurement apparatus 100 in order to acquire the position of the antenna 42 in the above embodiment. However, the number of measurement points for acquiring the position of the antenna 42 is not limited to two. The number of measurement points for acquiring the position of the antenna 42 may be less than two or greater than two. For example, as illustrated in FIG. 12, one measurement point A3 may be directly measured by the external measurement apparatus 100. The measurement point A5 may indicate the position of the center of the antenna 42.

Figure 13:
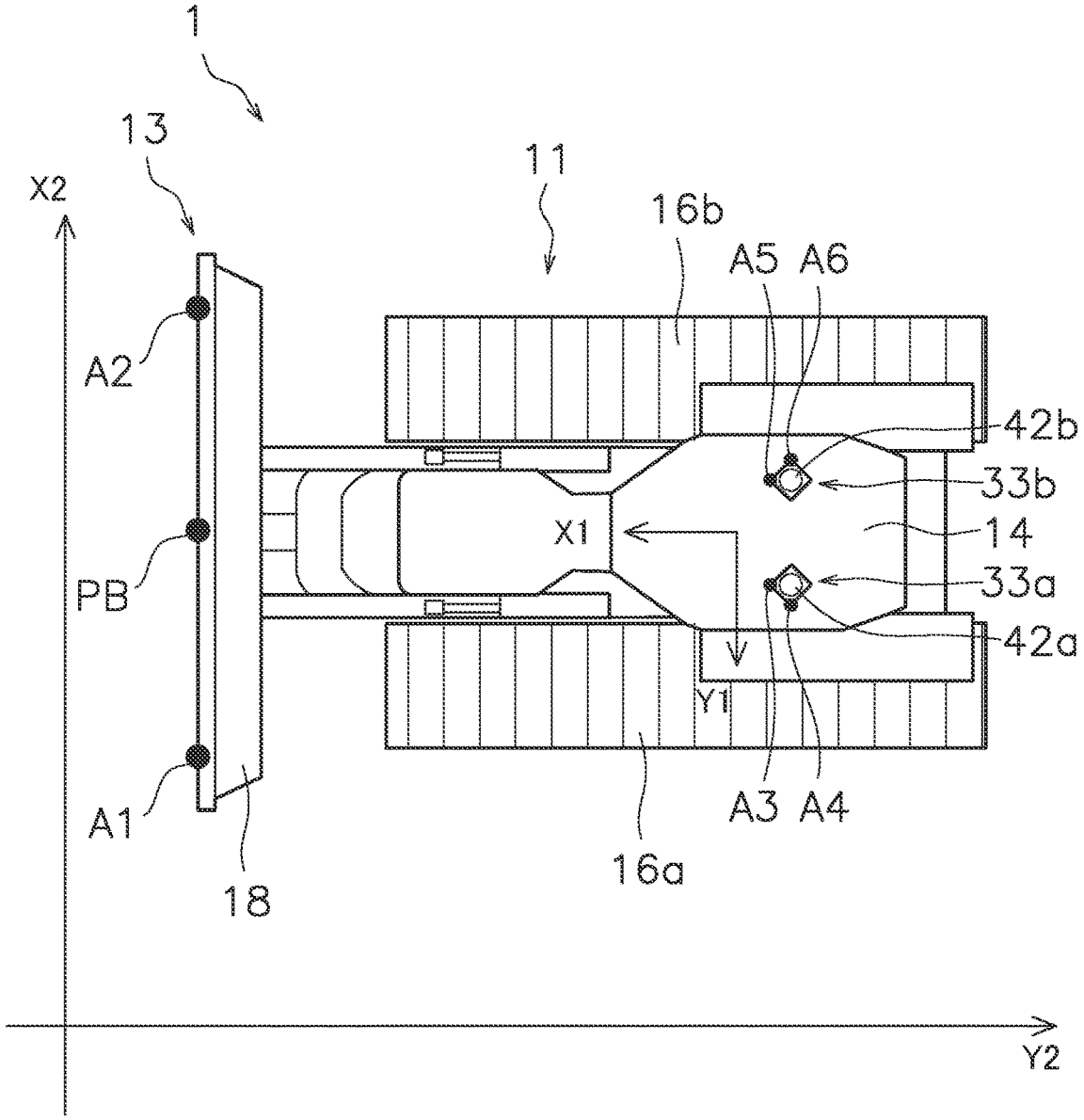
FIG. 13 illustrates a third modified example of the measurement points.

The number of the positional sensor 33 is one in the above embodiment. However, the number of positional sensors may be two or greater than two. For example, as illustrated in FIG. 13, the work machine 1 may include a first positional sensor 33*a* and a second positional sensor 33*b*. In this case, the calibration may be performed with the same method as the above embodiment on the positional sensors 33*a* and 33*b*. In FIG. 13, the measurement points A3 and A4 are the measurement points of an antenna 42*a* of the first positional sensor 33*a* Measurement points A5 and A6 are the measurement points of an antenna 42*b* of the second positional sensor 33*b*.

According to the present disclosure, the efficiency of work by a work machine can be improved.

The invention claimed is:

1. A system for calibrating a work machine including a vehicle body and a work implement attached to the vehicle body, by using an external measurement apparatus, the system comprising:

an attitude sensor that outputs attitude data indicative of an attitude of the vehicle body;

a positional sensor attached to the vehicle body;

a storage device that stores machine data indicative of a position of the positional sensor in a vehicle body coordinate system;

an input device that receives an input of calibration data including positions of at least two predetermined measurement points on the work machine measured by the external measurement apparatus, the at least two predetermined measurement points being spaced apart in a vehicle width direction of the work machine and the positions of the at least two predetermined measurement points being measured in an external coordinate system different from the vehicle body coordinate system, and a position of the positional sensor in the external coordinate system measured by the external measurement apparatus; and a processor configured to calculate a deviation between an azimuth of the vehicle body coordinate system and an azimuth of the external coordinate system based on the at least two predetermined measurement points, and calibrate the machine data based on the attitude data, the deviation, and the position of the positional sensor in the external coordinate system.

2. The system according to claim 1, wherein the processor is further configured to calibrate the machine data based on a difference between a position of the positional sensor in the vehicle body coordinate system calculated from the calibration data and the position of the positional sensor indicated by the machine data.

3. The system according to claim 1, wherein the attitude data includes a roll angle of the vehicle body.

4. The system according to claim 1, wherein the attitude data includes a pitch angle of the vehicle body.

5. The system according to claim 1, wherein the at least two predetermined measurement points are included on the work implement.

6. The system according to claim 5, wherein the work implement includes a blade tip, and the at least two predetermined measurement points are included on the blade tip.

7. The system according to claim 6, wherein the at least two predetermined measurement points are positioned inward of a left end and a right end of the blade tip in the vehicle width direction.

8. The system according to claim 1, wherein the at least two predetermined measurement points are included on the vehicle body.

9. A system for calibrating a work machine using an external measurement apparatus, the work machine including a vehicle body, a work implement attached to the vehicle body, a crawler belt, and a sprocket for driving the crawler belt, the system comprising:

an attitude sensor that outputs attitude data indicative of an attitude of the vehicle body;

a positional sensor attached to the vehicle body;

a storage device that stores machine data indicative of a position of the positional sensor in a vehicle body coordinate system;

an input device that receives an input of calibration data including a position of a predetermined measurement point on the work machine measured by the external measurement apparatus, the measurement point being included on the sprocket, and a position of the positional sensor measured by the external measurement apparatus; and a processor configured to calibrate the machine data based on the calibration data and the attitude data.

10. The system according to claim 1, wherein the positional sensor includes a receiver of positioning signals from a satellite, and an antenna, and the position of the positional sensor is the position of the antenna.

11. A method executed by a processor for calibrating a work machine by using an external measurement apparatus, the work machine including a vehicle body, a work implement attached to the vehicle body, an attitude sensor that outputs attitude data indicative of an attitude of the vehicle body, and a positional sensor attached to the vehicle body, the method comprising:

acquiring the attitude data;

storing machine data in a storage device, the machine data being indicative of a position of the positional sensor in a vehicle body coordinate system;

acquiring calibration data including positions of at least two predetermined measurement points on the work machine measured by the external measurement apparatus, the at least two predetermined measurement points being spaced apart in a vehicle width direction of the work machine and the positions of the at least two predetermined measurement points being measured in an external coordinate system different from the vehicle body coordinate system, and a position of the positional sensor in the external coordinate system measured by the external measurement apparatus; and calculating a deviation between an azimuth of the vehicle body coordinate system and an azimuth of the external coordinate system based on the at least two predetermined measurement points; and calibrating the machine data based on the attitude data, the deviation, and the position of the positional sensor in the external coordinate system.

12. The method according to claim 11, wherein the calibrating of the machine data includes calibrating the machine data based on a difference between a position of the positional sensor in the vehicle body coordinate system calculated from the calibration data and the position of the positional sensor indicated by the machine data.

13. The method according to claim 11, wherein the attitude data includes a roll angle of the vehicle body.

14. The method according to claim 11, wherein the attitude data includes a pitch angle of the vehicle body.

15. The method according to claim 11, wherein the at least two predetermined measurement points are included on the work implement.

16. The method according to claim 15, wherein the work implement includes a blade tip, and the at least two predetermined measurement points are disposed on the blade tip.

17. The method according to claim 16, wherein the at least two predetermined measurement points are positioned inward of a left end and a right end of the blade tip in the vehicle width direction.

18. The method according to claim 11, wherein the at least two predetermined measurement points are included on the vehicle body.

19. A method executed by a processor for calibrating a work machine by using an external measurement apparatus, the work machine including a vehicle body, a work implement attached to the vehicle body, an attitude sensor that outputs attitude data indicative of an attitude of the vehicle body, a positional sensor attached to the vehicle body, a crawler belt, and a sprocket for driving the crawler belt, the method comprising:

acquiring the attitude data;

acquiring calibration data including a position of a predetermined measurement point on the work machine measured by the external measurement apparatus, the measurement point being included on the sprocket, and a position of the positional sensor measured by the external measurement apparatus; and calibrating machine data indicative of the position of the positional sensor in a vehicle body coordinate system, based on the calibration data and the attitude data.

20. A device for calibrating a work machine by using an external measurement apparatus, the work machine including a vehicle body, a work implement attached to the vehicle body, an attitude sensor that outputs attitude data indicative of an attitude of the vehicle body, and a positional sensor attached to the vehicle body, the device comprising:

an input device that receives an input of calibration data including positions of at least two predetermined measurement points on the work machine measured by the external measurement apparatus, the at least two predetermined measurement points being spaced apart in a vehicle width direction of the work machine and the positions of the at least two predetermined measurement points being measured in an external coordinate system different from the vehicle body coordinate system, and a position of the positional sensor in the external coordinate system measured by the external measurement apparatus; and a processor configured to calibrate machine data indicative of the position of the positional sensor in a vehicle body coordinate system different from the external coordinate system, the processor calibrating the machine data by calculating a deviation between an azimuth of the vehicle body coordinate system and an azimuth of the external coordinate system based on the at least two predetermined measurement points, and calibrating the machine data based on the attitude data, the deviation, and the position of the positional sensor in the external coordinate system.

* * * * *